US006202247B1

(12) United States Patent
Lorenz, Jr.

(10) Patent No.: US 6,202,247 B1
(45) Date of Patent: Mar. 20, 2001

(54) BOTTLE AND NIPPLE BRUSH

(75) Inventor: Michael A. Lorenz, Jr., Gahanna, OH (US)

(73) Assignee: The First Years Inc., Lake Forest, CA (US)

( * ) Notice: Subject to any disclaimer, the term of this patent is extended or adjusted under 35 U.S.C. 154(b) by 0 days.

(21) Appl. No.: 09/359,934

(22) Filed: Jul. 22, 1999

(51) Int. Cl.[7] ..... A47L 17/00
(52) U.S. Cl. ..... 15/118; 15/106; 15/211
(58) Field of Search ..... 15/106, 118, 164, 15/211, 244.1, 244.2; D4/105, 106, 116, 137; D32/35, 40, 42

(56) References Cited

U.S. PATENT DOCUMENTS

| | | | | |
|---|---|---|---|---|
| 336,746 | * | 2/1886 | Reisor | 15/211 |
| D. 339,474 | | 9/1993 | Nieson . | |
| D. 354,626 | | 1/1995 | Hurwitz . | |
| D. 375,595 | * | 11/1996 | Shumway et al. . | |
| D. 408,106 | * | 4/1999 | Cousins et al. | 15/164 |
| 1,259,245 | | 3/1918 | Kessler et al. . | |
| 1,510,898 | | 10/1924 | Nikicser . | |
| 1,757,366 | | 5/1930 | Hertzberg . | |
| 1,890,894 | * | 12/1932 | Arnold et al. | 15/244.1 |
| 2,303,660 | | 12/1942 | Schickel . | |
| 2,334,690 | * | 11/1943 | Yden | 15/211 |
| 2,682,073 | * | 6/1954 | Hoffman | 15/211 |
| 2,683,886 | | 7/1954 | Neumann . | |
| 2,792,579 | * | 5/1957 | Roy | 15/164 |
| 2,893,029 | * | 7/1959 | Vosbikian et al. | 15/118 |
| 3,047,897 | | 8/1962 | Bartos et al. . | |
| 3,052,910 | | 9/1962 | Kushner . | |
| 3,181,193 | | 5/1965 | Nobles et al. . | |
| 3,409,926 | | 11/1968 | Martin . | |
| 3,795,933 | | 3/1974 | Seufert . | |
| 3,935,611 | | 2/1976 | Locher . | |
| 3,965,521 | | 6/1976 | Wardell . | |
| 4,167,796 | | 9/1979 | De Pamphillis . | |
| 4,184,221 | | 1/1980 | Edwards . | |
| 5,077,857 | | 1/1992 | Sellers . | |
| 5,295,278 | | 3/1994 | Condon et al. . | |
| 5,339,480 | * | 8/1994 | Murg et al. | 15/164 |
| 5,410,772 | | 5/1995 | Lewis . | |
| 5,479,673 | | 1/1996 | Carton . | |
| 5,491,863 | | 2/1996 | Dunn . | |
| 5,709,003 | * | 1/1998 | Batch | 15/106 |

FOREIGN PATENT DOCUMENTS

| | | | | |
|---|---|---|---|---|
| 573626 | * | 4/1933 | (DE) | 15/106 |
| 1255468 | * | 1/1961 | (FR) | 15/106 |

* cited by examiner

*Primary Examiner*—Terrence R. Till
(74) *Attorney, Agent, or Firm*—Fish & Richardson P.C.

(57) ABSTRACT

An apparatus for cleaning a baby bottle and an artificial nipple includes a handle, a bottle brush head and a nipple brush head. The bottle brush head made of materials creating a multi-action cleansing ability is attached to the handle at a flexible neck for ease of cleaning the interior of a bottle. The bottle brush head may be replaced when worn. The nipple brush head, made of a spongy material, is attached such that it may be moved into a chamber within the handle when not in use, protecting it from contact with foreign surface. The nipple brush head may also be replaced when worn.

27 Claims, 4 Drawing Sheets

BOTTLE AND NIPPLE BRUSH

BACKGROUND OF THE INVENTION

The invention relates generally to a cleaning apparatus and in particular to a bottle brush and nipple brush combination.

Adults often use a bottle to feed infants. These bottles typically have an artificial nipple which the infant sucks on to extract baby formula contained in the bottle. To limit growth of potentially harmful bacteria, it is recommended to clean the bottle and nipple after each use. Due to the shapes of the bottle and nipple, and due to the materials with which they are typically made, different devices such as brushes of differing materials and shapes are often used to clean the bottle and the nipple.

SUMMARY OF THE INVENTION

In general, in one aspect, the invention provides an apparatus for cleaning a baby bottle and an artificial nipple. The apparatus includes a handle providing a chamber, a bottle brush head and a nipple brush head. The bottle brush head is configured to clean an interior portion of a baby bottle. The nipple brush head is configured to clean an interior portion of the artificial nipple. The bottle brush head and the nipple brush head are attached to the handle. The nipple brush head is attached in such a manner that it may be moved from a first position within the handle chamber to a second position outside the chamber while remaining attached to the handle.

Implementations of the invention may include one or more of the following features. The bottle brush comprises expanded polymeric foam and glass mop materials. The bottle brush head has a layer of foam material disposed adjacent a layer of glass mop material. The handle further has an extension element comprising first and second members joined by a hinge. The members and hinge attaching the bottle brush head to the handle when the bottle brush head materials are placed between the members, the materials being placed between the members when the members and hinge are in open position and being attached to the handle when the members and hinge are moved to closed position. The members are held in closed position by a snap joint. The members are held in closed position by a weld joint. The nipple brush head is pivotally attached to the handle, such nipple brush head rotating between the first and second positions. The nipple brush head has a stop adapted to engage a portion of the handle substantially preventing it from rotating beyond its second position. The nipple brush head is made from a spongy material. The handle has a first portion and a second portion attached by a hinge and defining a chamber. The first and second portions of the handle are moveable relative to each other about the hinge between a closed position capturing a portion of the nipple brush head and an open position in which the nipple brush head can be detached from the handle. The handle has a flexible neck connected to the bottle brush head.

In general, in another aspect, the invention provides an apparatus for cleaning a baby bottle and an artificial nipple. The apparatus has a handle, a bottle brush head and a nipple brush head. The handle has a proximal end, a distal end and provides a chamber at a distal end. The bottle brush head is attached to the proximal end of the handle. It is configured to clean an interior portion of the baby bottle. The nipple brush head is configured to clean an interior portion of an artificial nipple. It is attached to the distal portion of the handle. The nipple brush head moves from a first position within the chamber to a second position outside the chamber, while remaining attached to the handle.

Implementations of the invention may include one or more of the following features. The proximal end of the handle has an extension element comprising first and second members joined by a hinge. The members and hinge are positioned such that materials to form the bottle brush head are placed between the members at the proximal end of the handle when the hinge and members are in an open position and the bottle brush head is attached to the handle when the members and hinge are moved to a closed position. The members attach the bottle brush head permanently to the handle once moved to closed position. The handle provides at least one opening into the chamber at both its proximal and distal ends.

Embodiments of the invention may provide one or more of the following advantages. A single apparatus can be used to clean a bottle and an artificial nipple. A nipple brush head can be protected while not in use. A nipple brush head can be moved to different orientations relative to a handle, e.g. without detaching the nipple brush head from the handle. A bottle brush head can be made of a foam material and a glass mop material. Such a bottle brush head can clean a bottle better than standard nylon bristle or foam brush. Nipple brush heads and bottle brushes heads can be permanent or replaceable. Openings are provided to allow for the drainage of water and/or other liquids from both ends of the apparatus.

Other features and advantages of the invention will be apparent from the following drawings, description, and claims.

DESCRIPTION OF THE PREFERRED EMBODIMENTS

Figure 1:
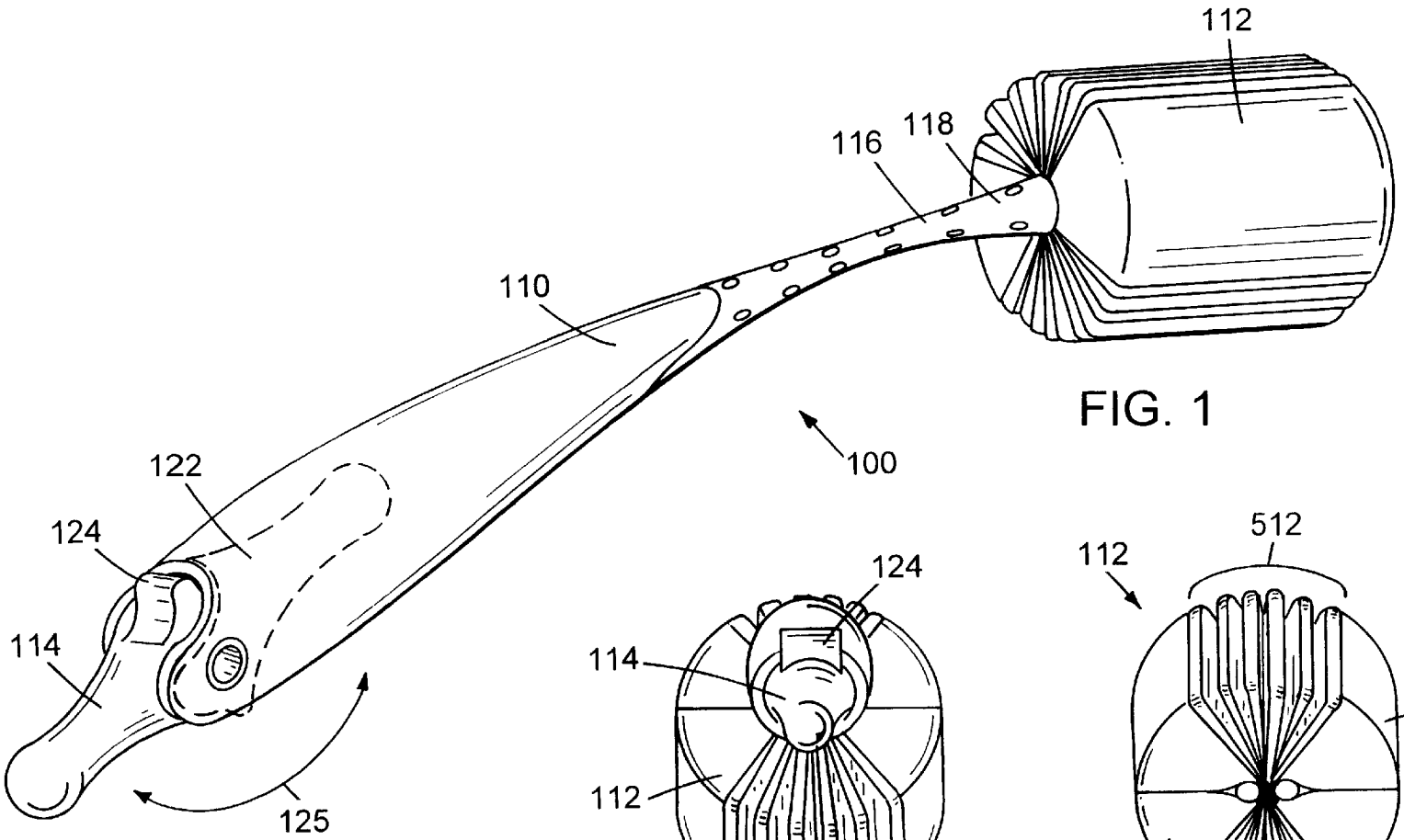
FIG. 1 is a perspective view of a combination bottle and nipple brush according to the invention.
Figure 2:
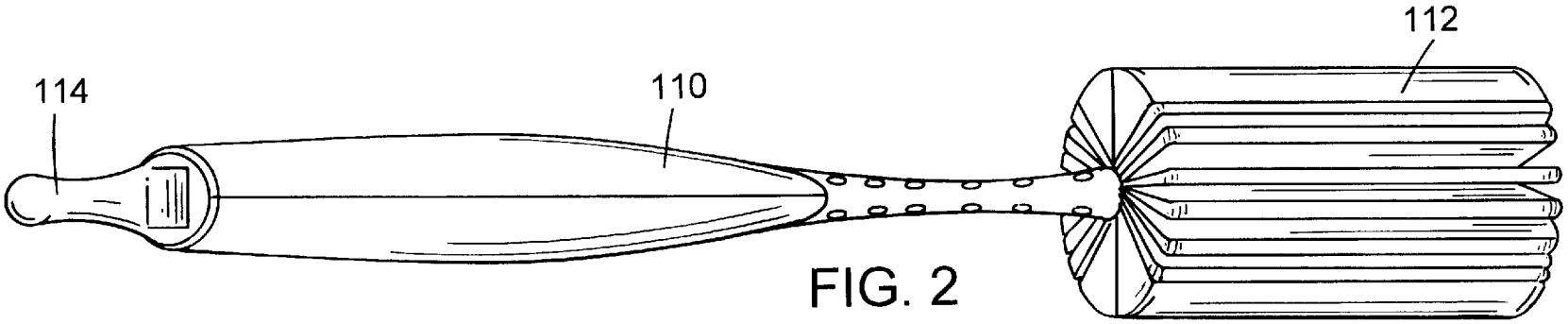
FIG. 2 is top perspective view of the combination bottle and nipple brush shown in FIG. 1.
Figure 3:
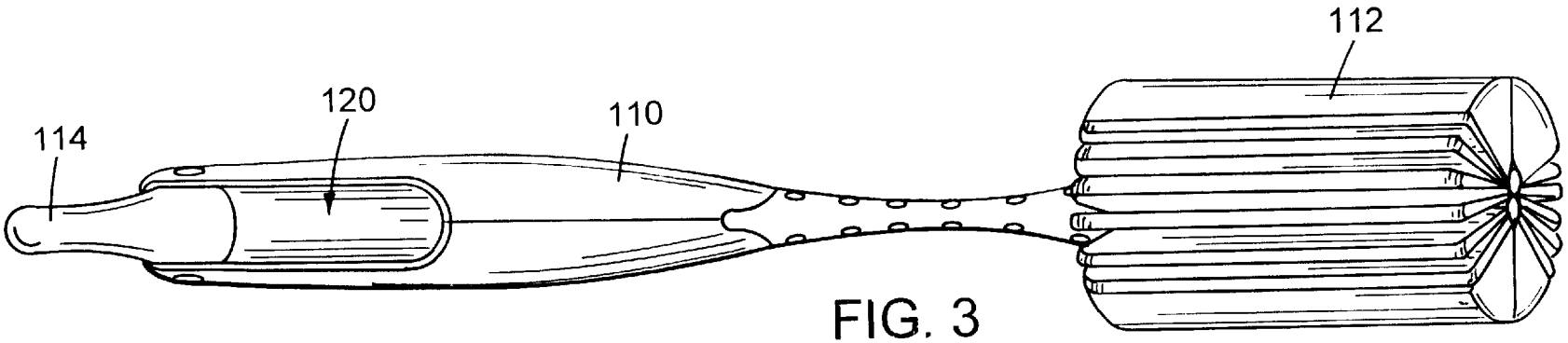
FIG. 3 is a bottom perspective view of the combination shown in FIG. 2.

Referring to FIGS. 1, 2 and 3, a combination bottle and nipple brush 100 includes a handle 110, a bottle brush 112 and a nipple brush 114. Handle 110 includes a neck 116 located at a proximal end 118 and defines a chamber 120 (FIG. 3) within handle 110 extending to a distal end 122. Handle 110 is made of a suitable molded plastic, e.g., polypropylene.

Figure 5:
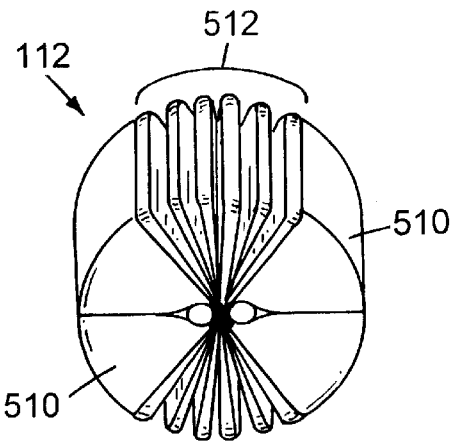
FIG. 5 is a front view of the combination shown in FIG. 1.
Figure 4:
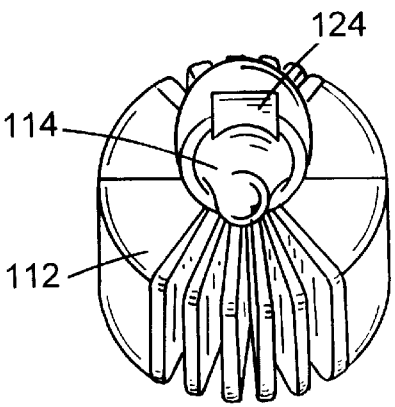
FIG. 4 is a rear view of the combination shown in FIG. 1.

Bottle brush head 112, attached to the neck 116 of handle 110, is designed to efficiently clean a baby bottle. Referring also to FIG. 5, bottle brush head 112 is formed of two layers of an expanded polymeric foam material 510, such as polyurethane foam, with six layers of a glass mop material 512 disposed therebetween. In other embodiments, bottle brush head 112 may be made from any combination of foam, glass mop, nylon, sponge, soft rubber, or other appropriate bottle cleaning or brush materials.

Foam material 510 is a soft, porous material capable of retaining water and other liquids. Glass mop material 512 is a flexible, resilient material, such as a coated felt-type material similar to materials typically used for cleaning flaps in automatic drive-through car washes. Glass mop material 512 is die-cut to a proper size and shape, allowing the various layers of the bottle brush head 112 to clean the interior of a baby bottle at various different angles. Such a combination of soft, absorbent foam materials 510, and relatively rigid yet flexible glass mop materials 512 positioned at different angles within bottle brush head 112 provide a multi-action cleansing ability for cleaning the interior of a bottle with bottle brush head 112.

Referring to FIGS. 1, 2, 3 and 4, nipple brush 114, pivotally attached at the distal end of handle 110, is sized and shaped to efficiently clean within an artificial nipple typically used to feed an infant. Nipple brush 114 is made, here, of molded polyurethane foam, but may be made of any appropriate brush material. Nipple brush 114 is configured to be stored in a first position within chamber 120, as shown in phantom in FIG. 1, and to be pivoted to a second position, outside of chamber 120, as shown in FIG. 1 in solid lines, until a stop 124 on nipple brush 114 engages handle 110. Stop 124 is a raised surface on nipple brush 114 positioned to engage handle 110 when brush 114 is moved in direction 125 to reach its fully open position for cleaning an artificial nipple. Such a construction allows nipple brush 114 to be stored within chamber 120, protected from undesired contact with other items, and also to remain attached to handle 110 as nipple brush 114 is moved from its closed position in chamber 120.

Figure 6:
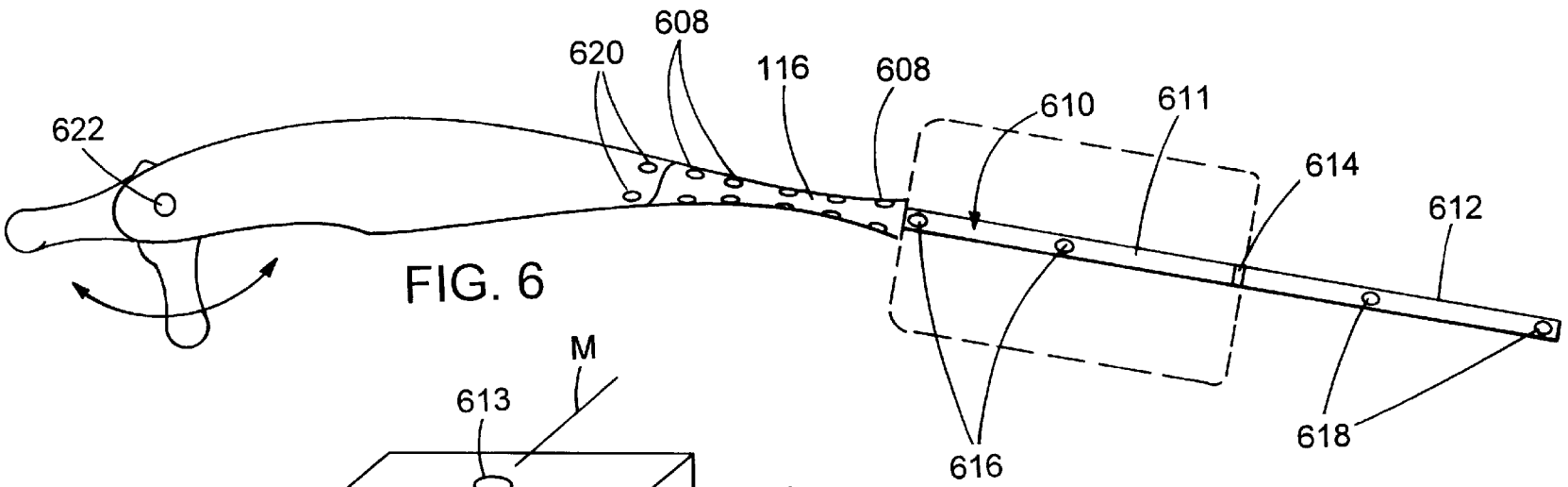
FIG. 6 is a side view of a combination bottle and nipple brush according to the invention with a bottle brush head in phantom and a member and a hinge used to attach the bottle brush head, the hinge being shown in an opened position.

Referring to FIG. 6, handle 110 is made of integrally molded plastic forming a neck 116 and a chamber 120 (FIG. 3). Neck 116 defines a series of notches 608 serving to increase the flexibility of neck 116, improving the ability of handle 110 to flex as bottle brush 114 cleans a baby bottle.

Drainage openings 620 defined through the handle at the base of neck 116 allow liquids such as water to drain from within chamber 120, thereby to lower any possibility of bacteria growth within handle 110, e.g. as may result should liquids remain trapped inside handle 110.

An extension element 610 from neck 116 has a first portion 611 connected by hinge 614 to a second portion 612. Hinge 614 is a so-called living hinge, being a point in a molded plastic article designed to bend and act like a hinge. As shown, hinge 614 is a thinned portion of extension element 610. Members 611, 612 pivot between an open position (FIG. 6) and a closed position (FIG. 5), wherein the members 611, 612 are adjacent to each other. Member 611, 612 also define cooperating snap posts 616 and snap receptacles 618, respectively, which together form snap joints when members 611, 612 are moved to their closed position. In one embodiment, members 611, 612 can be coupled by closing the snap joints and uncoupled by opening the snap joints. In another embodiment, e.g. where the brush 100 is intended to be disposable, the snap joints may be replaced by more permanent joints, such as weld joints.

Figures 7, 7A:
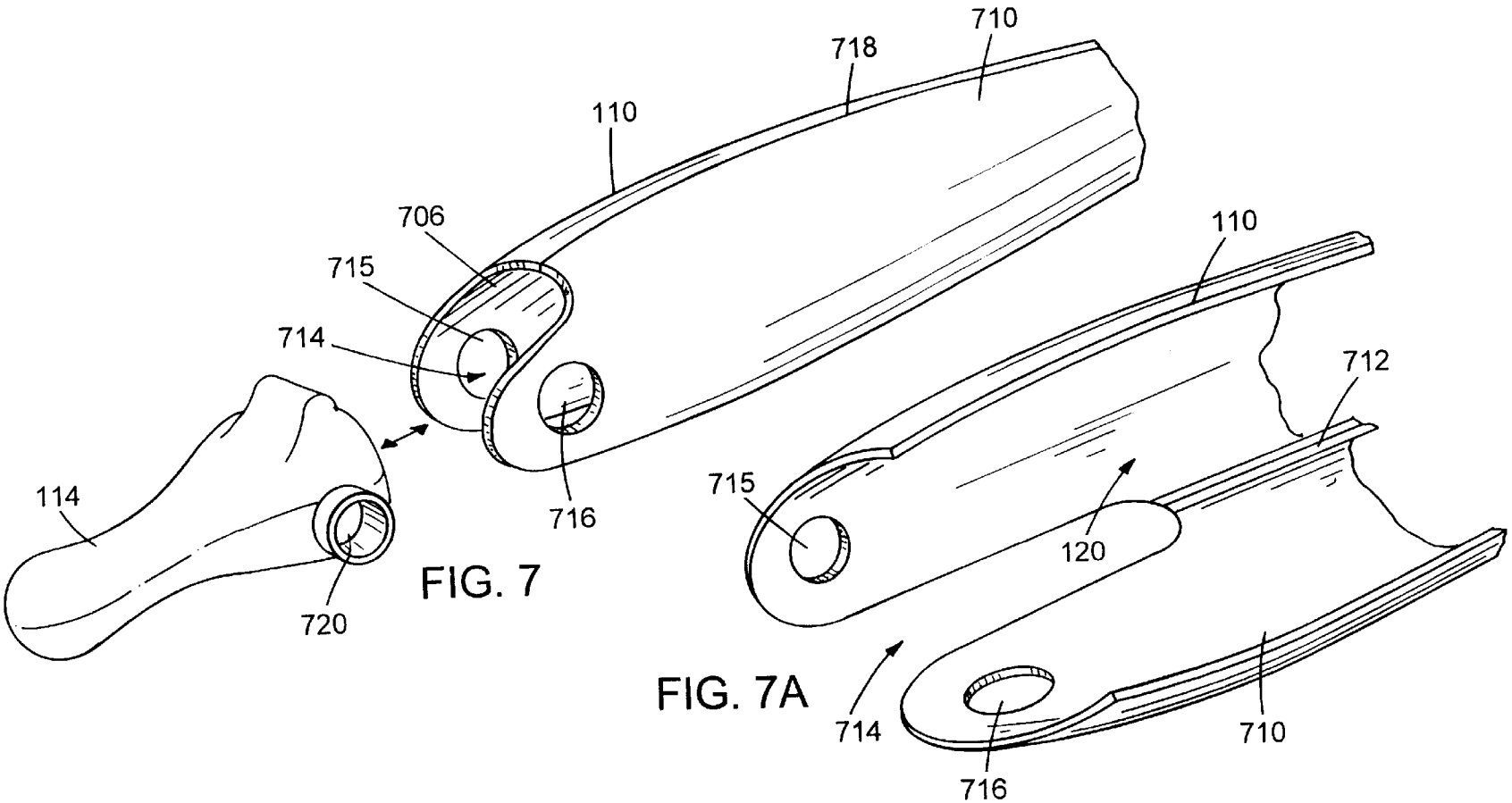
FIG. 7 is an exploded perspective view of a distal portion of the combined bottle and nipple brush according to the invention showing the distal portion in a closed position.
FIG. 7A is an exploded perspective view of the distal portion of the combined bottle and nipple brush according to the invention showing the distal portion in an open position.

Referring now to FIGS. 7 and 7A, handle 110 has a panel 710, a hinge 712 and three openings 714, 715 and 716 defining chamber 120. Panel 710 is integrally connected to handle 110 by hinge 712, here, a living hinge. Panel 710 can pivot on hinge 712 to provide access to chamber 120 when panel 710 is in its open position (FIG. 7A). Panel 710 is connected along its top edge 718 to handle 110 by a weld joint (FIG. 7). However, other types of connection are acceptable such as a snap joint or another semi-permanent joint. Such a construction strengthens handle 110, but inhibits the replacement of nipple brush 114. In other embodiments, panel 710 may be affixed to handle 110 by a less permanent joint, such as a snap joint to facilitate the periodic replacement or cleaning of nipple brush 114 when not in use.

Figure 6A:
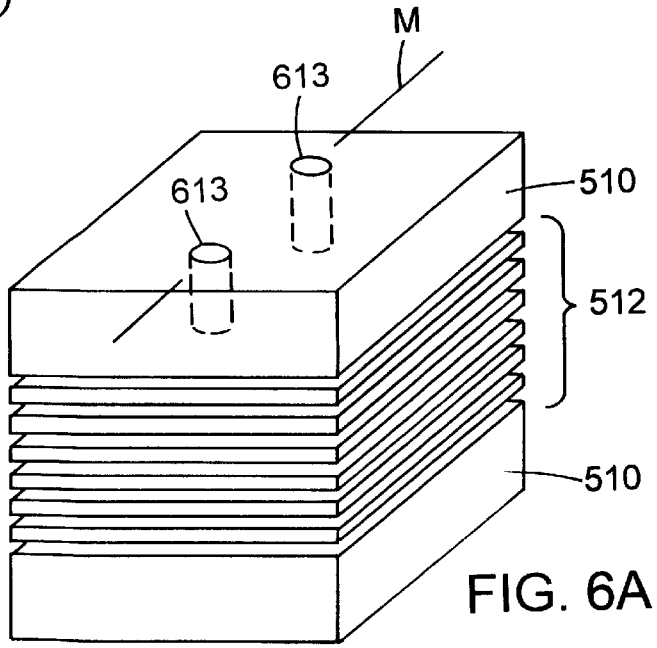
FIG. 6A is a perspective view of an assembly of layers or plies to be formed into the bottle brush head.

Referring to FIGS. 6 and 6A, bottle brush head 112, shown here in phantom, is attached to handle 110 of brush 100 by members 611, 612 of extension element 610. In particular, layers of materials 510, 512 are placed between members 611, 612 when hinge 614 is in its open position. In placing them onto member 611, the layers of materials 510, 512 are positioned so that holes 613 in layers 510, 512 line up with snap posts 616 of member 611. Member 612 is pivoted about hinge 614 toward member 611, compressing layers 510, 512 along axis, M, until snap receptacles 618 engage snap posts 616 to form snap joints, members 611, 612 securing the layers 510, 512 in the form of a generally cylindrical brush head 112 (FIG. 1). Brush head 112 is thus secured between members 611, 612 by the snap joints.

Bottle brush head 112 can be removed from handle 110 and replaced by opening the snap joints. As mention above, in other embodiments, the brush 100 may be disposable, with members 611, 612 held in closed position, e.g., by adhesives, and/or joint welds, to substantially prevent the removal of brush head 112 from handle 110.

Referring now to FIGS. 6 and 7, nipple brush 114 is movably attached to handle 110 of combination brush 100 at joint 622. Here, joint 622 is formed from posts 720 (only one shown) on nipple brush 114 and openings 715 and 716 in handle 110. To make such a joint, nipple brush 114 is placed within chamber 120 of handle 110 when panel 710 is in its open position. Nipple brush 114 is positioned to align posts 720 with openings 715 and 716. Panel 710 is moved into its closed position with openings 715 and 716 receiving posts 720.

Nipple brush 114 can be pivotally rotated through opening 714 and into and out from chamber 120. Thus, nipple brush can be moved within chamber 120 to protect it from contact with, e.g., foreign surfaces and be removed from chamber 120 to be used to clean artificial nipples or other items.

In operation, the combination bottle and nipple brush 100 described above may be used to clean baby bottles and artificial nipples. Baby bottles are cleaned using combination brush 100 by inserting bottle brush head 112 into a bottle (not shown) along with soap and water and moving handle 110 in an up and down or rotating motion until the bottle is clean. Such movement will typically be done with the nipple brush 114 in its stored position within chamber 120.

Artificial nipples (not shown) are cleaned by combination brush 100 by rotating nipple brush 114 out from its stored position within chamber 120. Soap and water are applied to the brush 114 and to the nipple. The nipple brush 114 is then used to scrub the surfaces of the nipple, including the inner surface. The combination brush 100. may be hung up to dry for later use.

One skilled in the art may now make numerous modifications and uses of and departures from the specific apparatus disclosed herein without departing from the inventive concepts. In some of these embodiments all of the joints described above may be replaced by one or more kinds of joints such as adhesives, buttons, clamps, or other equivalences. In other embodiments materials used in making the apparatus may be altered. Consequently, the invention is to be construed as embracing each and every novel feature and novel combinations of features present in or possessed by the apparatus disclosed herein and is limited only by the spirit and scope of the appended claims.

What is claimed is:

1. An apparatus for cleaning a baby bottle and an artificial nipple, comprising:

a handle providing a chamber;

a bottle brush head configured to clean an interior portion of said baby bottle and attached to said handle, said brush head comprising a combination of expanded polymeric foam materials and lass mop materials; and a nipple brush head configured to clean an interior portion of said artificial nipple and attached to said handle, such nipple brush head movable from a first position within said chamber to a second position outside said chamber, the nipple brush head remaining attached to said handle when moved from said first position to said second position.

2. The apparatus according to claim 1, wherein a layer of the expanded polymeric foam material is disposed adjacent a layer of the glass mop material.

3. The apparatus according to claim 1, wherein the handle further comprises an extension element comprising a first member and a second member connected by a hinge, materials of said bottle brush head being placed between said first and second members when said first and second members and said hinge are in an open position and said bottle brush head be secured to said handle when said first and second members and said hinge are moved to a closed position.

4. The apparatus according to claim 3, wherein the members of the extension element are held in said closed position by a snap joint.

5. The apparatus according to claim 3, wherein the members of the extension element are held in said closed position by a weld joint.

6. The apparatus according to claim 1, wherein the nipple brush head is pivotally attached to the handle, such nipple brush head rotating between the first and second positions.

7. The apparatus according to claim 6, wherein the nipple brush head further comprises a stop adapted to engage a portion of said handle to substantially prevent such nipple brush head from rotating beyond said second position.

8. The apparatus according to claim 1, wherein the nipple brush head is made from a spongy material.

9. The apparatus according to claim 1, wherein a first portion and a second portion of said handle defining said chamber are attached by a hinge.

10. The apparatus according to claim 9, wherein said first and second portions are movable relative to each other about said hinge between a closed position capturing a portion of said nipple brush head and an open position in which said nipple brush head can be detached from said handle.

11. The apparatus according to claim 1 wherein said handle further comprises a flexible neck connected to said bottle brush head.

12. An apparatus for cleaning a baby bottle and an artificial nipple, comprising:

a handle having a proximal end and a distal end providing a chamber at said distal end;

a bottle brush head configured to clean an interior portion of said baby bottle and attached to the proximal end of said handle; and a nipple brush head configured to clean an interior portion of the artificial nipple and attached to said handle, such nipple brush head movable from a first position within said chamber to a second position outside said chamber, the nipple brush head remaining attached to said handle when moved from said first position to said second position;

the proximal end of said handle further comprising an extension element having a first member and a second member joined by a hinge, the members and the hinge positioned such that materials of said bottle brush head placed between the members at the proximal end of said handle when the hinge and members are in an open position are secured to said handle when the members and hinge are moved to a closed position.

13. The apparatus according to claim 12, wherein said members attach said bottle brush head permanently to said handle once moved to said closed position.

14. The apparatus according to claim 12, wherein the handle defines at least one opening into said chamber at both said proximal and said distal ends.

15. A brush comprising:

a bottle brush head configured to fit through an opening in a bottle, the bottle brush head including a glass mop material and a water-absorbent material each providing a portion of an exterior surface of the bottle brush head, the glass mop material and the water-absorbent material being disposed in alternating layers; and a handle connected to the bottle brush head.

16. An apparatus for cleaning a baby bottle and an artificial nipple, comprising:

a handle providing a chamber, the handle having first and second portions attached by a hinge;

a bottle brush head configured to clean an interior portion of said baby bottle and attached to said handle; and a nipple brush head configured to clean an interior portion of said artificial nipple and attached to said handle, such nipple brush head movable from a first position within said chamber to a second position outside said chamber, the nipple brush head remaining attached to said handle when moved from said first position to said second position.

17. The apparatus according to claim 16, wherein said first and second portions are movable relative to each other about said hinge between a closed position capturing a portion of said nipple brush head and an open position in which said nipple brush head can be detached from said handle.

18. An apparatus for cleaning a baby bottle and an artificial nipple, comprising:

a handle providing a chamber;

a bottle brush head configured to clean an interior portion of said baby bottle and attached to said handle; and a nipple brush head configured to clean an interior portion of said artificial nipple and attached to said handle, such nipple brush head movable from a first position within said chamber to a second position outside said chamber, the nipple brush head remaining attached to said handle when moved from said first position to said second position;

said handle further comprising a flexible neck connected to said bottle brush head.

19. The apparatus according to claim 18, wherein said brush head comprises a combination of expanded polymeric foam materials and glass mop materials.

20. The apparatus according to claim 18, wherein the handle further comprises an extension element comprising a first member and a second member connected by a hinge, materials of said bottle brush head being placed between said first and second members when said first and second members and said hinge are in an open position and said bottle brush head be secured to said handle when said first and second members and said hinge are moved to a closed position.

21. The apparatus according to claim 20, wherein the members of the extension element are held in said closed position by a snap joint.

22. The apparatus according to claim 20, wherein the members of the extension element are held in said closed position by a weld joint.

23. The apparatus according to claim 18, wherein the nipple brush head is pivotally attached to the handle, such nipple brush head rotating between the first and second positions.

24. The apparatus according to claim 23, wherein the nipple brush head further comprises a stop adapted to engage a portion of said handle to substantially prevent such nipple brush head from rotating beyond said second position.

25. The apparatus according to claim 18, wherein the nipple brush head is made from a spongy material.

26. The apparatus according to claim 18, wherein a first portion and a second portion of said handle defining said chamber are attached by a hinge.

27. The apparatus according to claim 26, wherein said first and second portions are movable relative to each other about said hinge between a closed position capturing a portion of said nipple brush head and an open position in which said nipple brush head can be detached from said handle.

* * * * *